United States Patent [19]

Ozeki et al.

[11] Patent Number: 4,800,997

[45] Date of Patent: Jan. 31, 1989

[54] COIN PASSAGEWAY IN COIN HANDLING MACHINE

[75] Inventors: Masamichi Ozeki, Ashikaga; Mamoru Takasaki, Nerima, both of Japan

[73] Assignee: Laurel Bank Machines Co., Ltd., Tokyo, Japan

[21] Appl. No.: 18,962

[22] Filed: Feb. 17, 1987

[30] Foreign Application Priority Data

Feb. 27, 1986 [JP] Japan ..... 61-42610

[51] Int. Cl.[4] ..... G07D 9/04; G07F 1/04

[52] U.S. Cl. ..... 194/344; 453/32

[58] Field of Search ..... 453/7, 11, 12, 56, 58, 453/59, 61, 62, 31, 32; 194/344; 53/212, 254

[56] References Cited

U.S. PATENT DOCUMENTS

| | | | |
|---|---|---|---|
| 2,881,975 | 4/1959 | Bower | 453/58 X |
| 3,906,964 | 9/1975 | Ushio et al. | 453/63 |
| 4,234,002 | 11/1980 | Uchida et al. | 453/63 |
| 4,412,550 | 11/1983 | Watanabe et al. | 453/61 |

FOREIGN PATENT DOCUMENTS

| | | | |
|---|---|---|---|
| 0104923 | 4/1984 | European Pat. Off. . | |
| 2317986 | 11/1973 | Fed. Rep. of Germany | 453/56 |
| 52-26295 | 2/1977 | Japan . | |
| 53-11293 | 1/1978 | Japan . | |
| 53-56094 | 5/1978 | Japan . | |
| 56-95774 | 7/1981 | Japan . | |
| 58-171318 | 10/1983 | Japan . | |
| 59-12688 | 4/1984 | Japan . | |
| 59-121491 | 7/1984 | Japan . | |

*Primary Examiner*—F. J. Bartuska

*Attorney, Agent, or Firm*—Fleit, Jacobson, Cohn & Price

[57] ABSTRACT

The width of a coin passageway in a coin handling machine is varied in accordance with the type of coins to be handled. The coin passageway comprises a pivotable rail extending from a guide member and pivotably mounted adjacent to the guide member, and a slide rail formed integrally on a slide bar. The slide bar is slidably inserted into the pivotable rail. A guide roller is formed on the end of the slide bar and engaged with a slide guide so that the sliding movement of the slide bar changes the guide roller from one position to another position and the pivotable rail is pivoted. A passageway width setting cam has a cam face which is adapted to act on the slide rail to move it translationally with the pivotable rail through the bar guide.

2 Claims, 2 Drawing Sheets

COIN PASSAGEWAY IN COIN HANDLING MACHINE

BACKGROUND OF THE INVENTION

The present invention relates to a coin passageway for guiding coins by type of coin in a coin handling machine which is adapted to perform sorting, counting, packing and other operations with respect to the coins.

There is known a coin passageway comprising two rails spaced away from each other and extending parallel to each other, these rails being moved by the same distance to provided a width matching the external diameter of coins to be handle. Such a coin passageway is shown, for example, in Japanese Laid-Open Patent Application No. 52-26295, 53-56094 or Japanese Laid-Open Utility Model Application No. 56 -95774. Japanese Laid-Open Patent Application No. 59-121491 discloses a coin passageway comprising a pair of rails, only one of the rails being movable to provide a variable width without change of the coin stacking position.

In the above prior art, the inlet of the passageway connected with an introducing passage leading to a rotary disc on which coins to be handled are placed is also is variable in width. Particularly, when the coins are moved to the introducing section of the coin passageway along a guide member under the action of centrifugal force in the rotating disc, the positional relationship between the rails and the guide member will be varied to produce a discontinuous portion on the guiding surface. This is not practicable for foreign coins having diameters which vary considerably.

SUMMARY OF THE INVENTION

An object of the present invention is to provide a coin handling machine having a coin passageway which will not require any discontinuous portion between said rails and the guide member such that many kinds of coins having various diameters can smoothly be inducted into the coin passageway. This can be accomplished by providing a pivotable rail mounted adjacent to the guide member such that the positional relationship between the pivotable rail and the guide member will not substantially be changed, and a slide rail movable to adjust the width of the coin passageway while being inclined. Thus, the pivotable rail can be pivoted relative to the slide rail to adjust the width of the free end or introducing portion of the pivotable rail such that the width of the coin passageway will symmetrically be adjusted by the same amount about the center thereof.

BRIEF DESCRIPTION OF THE DRAWINGS

The above and other objects of the Invention will be clear from the following description made with reference to the accompanying drawings, in which.

DESCRIPTION OF THE PREFERRED EMBODIMENT

Figure 1:
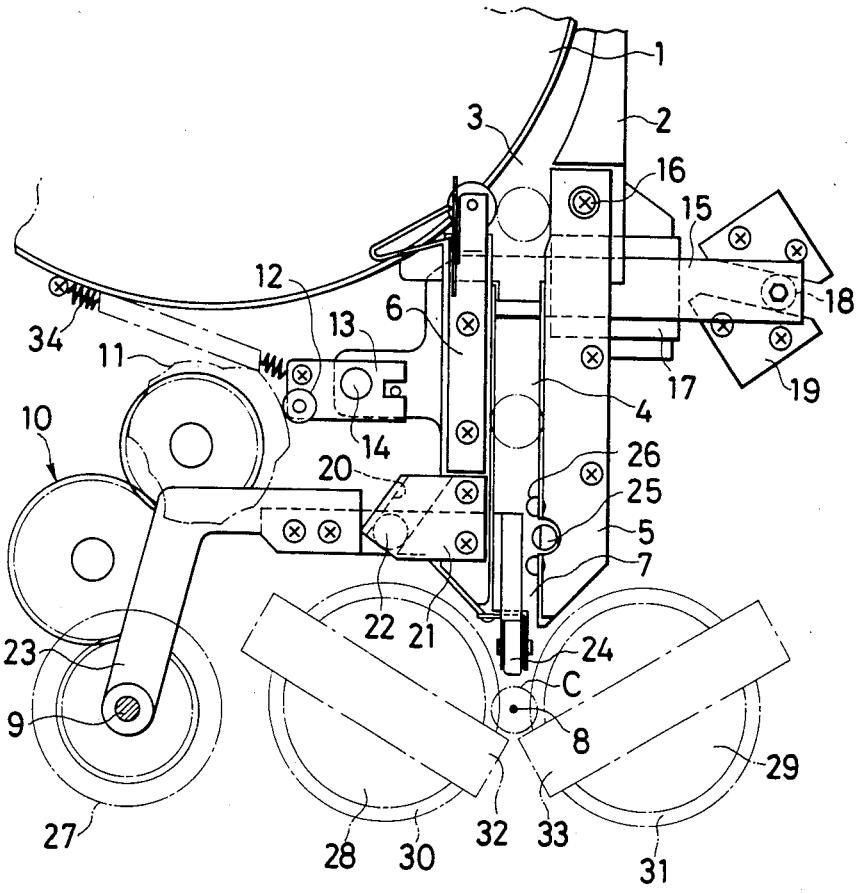
FIG. 1 is a plan view showing the primary parts of a coin passageway constructed in accordance with the present invention when it is set for coins having a smaller diameter.
Figure 2:
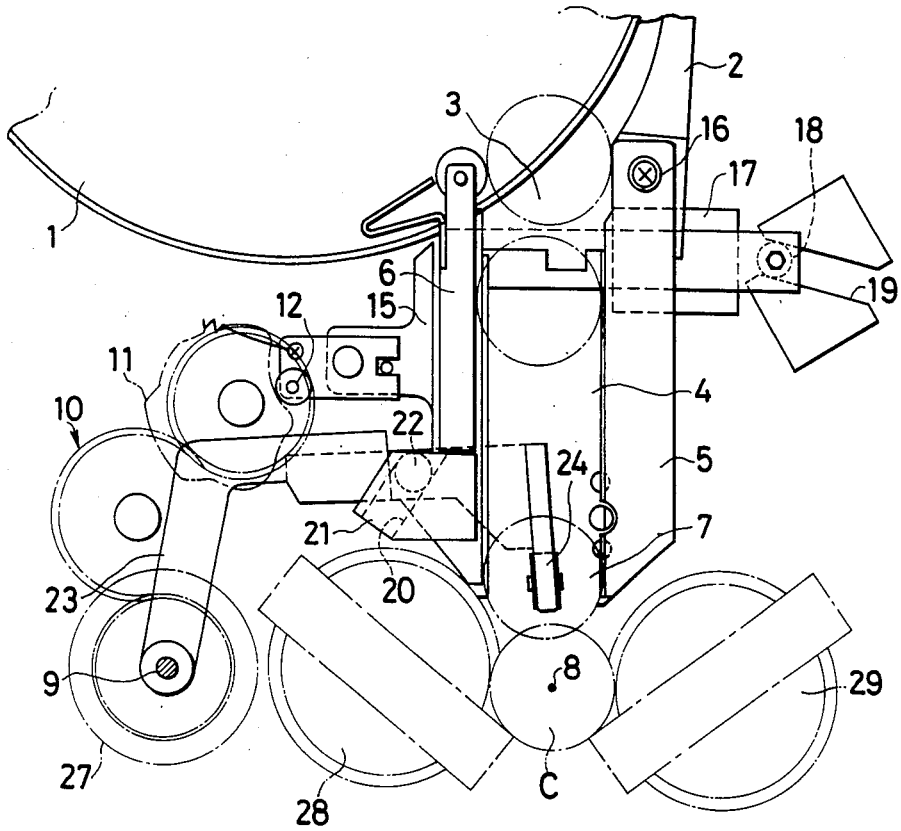
FIG. 2 is a plan view showing the primary parts when being set for coins having a larger diameter.

One embodiment of the present invention will now be described in detail with reference to the drawings.

Reference numeral 1 denotes a rotary disc having a guide member 2 formed on a part of the rotary disc.

Coins to be handled are placed on the rotary disc 1 and then moved into an introducing portion 3.

A coin passageway 4 comprises a pivotable rail 5 and a slide rail 6, these rails being spaced away from each other. The coins moved into the introducing portion 3 are further moved by a conveyor belt (not shown) to a discharging portion 7 from which the coins are further moved into a stacking area 8.

A coin type setting shaft 9 is provided which causes a passageway width setting cam 11 to rotate through a transmission system 10. The coin type setting shaft 9 is connected with a connecting element 13 having a cam head 12 engaging the cam face of the passageway width setting cam 11 under pressure. The connecting element 13 is connected with a slide bar 15 through a pin 14.

The slide bar 15 is formed with a slide rail 6 which is slidably nested in a bar guide 17 formed on the pivotable rail 5. The pivotable rail 5 is mounted about a pivot shaft 16 adjacent to the distal introducing portion 3 of the guide member 2. The distal end of the bar 15 has a guide roller mounted thereon which in turn engages a slide guide 19.

The other end of the slide bar 15 carries a grooved plate 21 having a groove 20 formed therein. This groove 21 is engaged by a pin 22 on a lever 23 which is loosely fitted over the coin type setting shaft 9. The distal end of the lever 23 is provided with a coin guiding wheel 24 which faces the center in the coin stacking area 8. The guiding wheel 24 is positioned on the bottom face of the coin passageway 4 to guide the coins being moved therein. Reference numeral 25 denotes a stop and reference numeral 26 designates a counter, these components being located on the pivotable rail 5.

Although the coin stacking area 8 may be of any suitable configuration, the illustrated embodiment includes a pair of stacking drums 28 and 29 which are formed with spiral ridges 30 and 31 arranged symmetrically relative to each other, and coin guards 32 and 33. The stacking drums 28 and 29 are symmetrically moved toward or away from each other to adjust the spacing therebetween depending on the external diameter of coins to be handled. Alternatively, these stacking drums may be replaced by the conventional exchangeable or variable diameter stacking cylinders. In any event, the central position of the stacked coins will not be changed irrespective of the diameter of the coins.

The operation of the aforementioned embodiment will be described below.

FIG. 1 shows the setting of the coin type setting dial 27 for coins having the smallest diameter. At this time, the width setting cam 11 is brought into contact with the cam head 12 so that the guide member 2 and the pivotable rail 5 define a guide surface at the introducing portion 3 as shown in FIG. 1.

When the coin type setting dial 27 is rotated to match coins having a larger diameter, the small radius cam face of the width setting cam 11 engages with the cam head 12 through the transmission system 10. The slide bar 15 is then pulled by a spring 34 to move the guide roller 18 leftwardly within the slide guide 19. At the same time, the groove 20 moves the guide roller 22 such that the lever 23 will slightly be pivoted counter-clockwise about the coin type setting shaft 9. Therefore, the guiding wheel 24 is moved sightly upwardly as viewed in FIG. 1. As a result, the pivotable rail 5 is slightly pivoted counter-clockwise about the pivot shaft 16 by the control of the guide roller 22, the bar guide 17 sliding with the slide bar 15, the slide guide 19 and the guide roller 18. In association with the pivotal motion of the rail 5, the slide bar 15 is slantedly moved slightly leftwardly to adjust the spacing between the slide and pivotable rails 6 and 5 for the larger diameter coins. Although not illustrated, the drum 28 and coin guard 32 set is spaced away from the similar drum 29 and coin guard 33 set. Alternatively, variable diameter stacking cylinders may be utilized to stack the coins.

The present invention provides a coin passageway having a pivotable rail pivotally mounted thereon adjacent to the introducing portion of the coin passageway to prevent a step from being produced, so that the guidance of the coin at the introducing portion can be stabilized. Since the pivotal motion of the pivotable rail, the inclination and translation of the slide rail and the reciprocation of the guiding wheel can be performed relative to one another without change of the central position in the stacked coins, the coin passageway according to the present invention is suitable particularly for use in a coin stacking machine which does not desire any change in the stacking position. Moreover, the present invention can improve the performance of the coin handling machine itself.

What we claim is:

1. A coin passageway in a coin handling machine, said coin passageway having a width capable of being changed depending on the type of coins to be handled, said coin passageway comprising:

a pivotable rail extending from a guide member and pivotally mounted adjacent to said guide member, a bar guide formed on said pivotable rail, a slide rail formed integrally on a slide bar, said slide bar being slidably inserted into said bar guide, a guide roller formed on the distal end of said slide bar, a slide guide for guiding said guide roller of said slide bar, and a passageway width setting cam having a cam face which is adapted to act on said slide rail to move said slide rail toward and away from said pivotable rail through said bar guide while maintaining a parallel relationship with said pivotable rail, and to pivot said pivotable rail in response to movement of said slide rail.

2. A coin passageway in a coin handling machine according to claim 1, further comprising a grooved plate mounted on said slide bar, a coin guiding wheel mounted on a lever for guiding coins, a pin mounted on said lever and cooperating with said grooved plate to move said coin guiding wheel.

* * * * *